US011844469B1

(12) United States Patent
Johnson

(10) Patent No.: US 11,844,469 B1
(45) Date of Patent: Dec. 19, 2023

(54) TOWEL CONFIGURED FOR ATTACHING TO AN OBJECT

(71) Applicant: Darren Keith Johnson, Phoenix, AZ (US)

(72) Inventor: Darren Keith Johnson, Phoenix, AZ (US)

( * ) Notice: Subject to any disclaimer, the term of this patent is extended or adjusted under 35 U.S.C. 154(b) by 0 days.

(21) Appl. No.: 18/238,508

(22) Filed: Aug. 27, 2023

(51) Int. Cl.

| | |
|---|---|
| ***A47K 7/04*** | (2006.01) |
| ***A47K 10/14*** | (2006.01) |
| ***A47K 10/02*** | (2006.01) |
| ***A47L 13/42*** | (2006.01) |
| ***A47L 13/16*** | (2006.01) |
| *A47K 10/12* | (2006.01) |

(52) U.S. Cl.
CPC ..... *A47K 10/14* (2013.01); *A47K 10/02* (2013.01); *A47L 13/16* (2013.01); *A47L 13/42* (2013.01); *A47K 10/12* (2013.01)

(58) Field of Classification Search
CPC ..... A47K 10/12; A47K 10/02; A63B 57/60
See application file for complete search history.

(56) References Cited

U.S. PATENT DOCUMENTS 2,420,344 A * 5/1947 Cook ..... A47K 10/02 D2/714
5,372,414 A * 12/1994 Lamonakis ..... A63B 57/60 206/812
11,278,163 B1 * 3/2022 Cowan ..... A47K 7/022
2007/0119013 A1 * 5/2007 Abreu ..... A63B 57/20 15/210.1
2012/0330213 A1 * 12/2012 Valdez ..... A41C 1/08 602/75
2014/0150156 A1 * 6/2014 Sprague ..... A47K 10/02 297/220
2016/0145786 A1 * 5/2016 Kinder ..... D05B 13/00 112/475.08
2016/0192719 A1 * 7/2016 Chrzanowska ..... A47K 10/02 2/74
2016/0324374 A1 * 11/2016 Livingston ..... B32B 3/10
2019/0269282 A1 * 9/2019 Romaya ..... A47L 13/16
2020/0359770 A1 * 11/2020 Aguero ..... A41D 3/08
2023/0097271 A1 * 3/2023 Zlotkin ..... A41D 1/14 2/76

* cited by examiner

*Primary Examiner* — Michael D Jennings
(74) *Attorney, Agent, or Firm* — Sam Pierce

(57) ABSTRACT

According to an aspect of the present invention, there is provided a towel arranged for attaching to an object, comprising: a first seam joining the end of the towel configured for attaching to an object with a medial portion of the towel, and a semirigid member arranged to switch between a straight configuration and a curled configuration, wherein the semirigid member is contained within the loop created by the end of the towel configured for attaching to an object being joined at the first seam with the medial portion of the towel.

16 Claims, 3 Drawing Sheets

TOWEL CONFIGURED FOR ATTACHING TO AN OBJECT

BACKGROUND

A need has been recognized in the prior art for a device for facilitating the ready use of a towel to ensure that the towel can easily be employed in a usable position. Towels and other absorbent materials are used by tradesmen, such as, painters, bartenders, waitresses, and roofers, to name a few. Towels and other absorbent materials are used by sporting event participants in a variety of services. Towels are used to wipe face and hands, clean soiled equipment such as golf balls, golf clubs, tennis racket handles, and tools.

Golf towels are carried in pockets, golf carts, or stored in hard to get compartments on a golf bag. A non-attachable towel most likely will end up lost or bulging out of a pocket. This method of carrying a towel can become an inconvenient task. Trying to locate a misplaced towel can take the sportsmen's concentration away from the sport. In the case of golf, when the towel is strapped or tucked into a golf bag, it requires the golfer to return to the bag to use the towel.

Prior art patents have disclosed a towel having means for attaching the towel to an article of clothing such as a belt loop or waist band. These towels and towel clip on devices that have been disclosed are designed to be attached to a belt loop or waistband of the wearer. However, in many applications, attachment to the belt loop or waistband of the wearer is inconvenient or impracticable, for example if the wearer is riding a bicycle. Thus, there is a need in the art for improved means for attaching a towel to an object.

SUMMARY OF INVENTION

According to an aspect of the present invention, there is provided a towel arranged for attaching to an object, comprising: a first seam joining the end of the towel configured for attaching to an object with a medial portion of the towel; and a semirigid member arranged to switch between a straight configuration and a curled configuration, wherein the semirigid member is contained within the loop created by the end of the towel configured for attaching to an object being joined at the first seam with the medial portion of the towel.

DETAILED DESCRIPTION OF THE DRAWINGS

Figure 1:
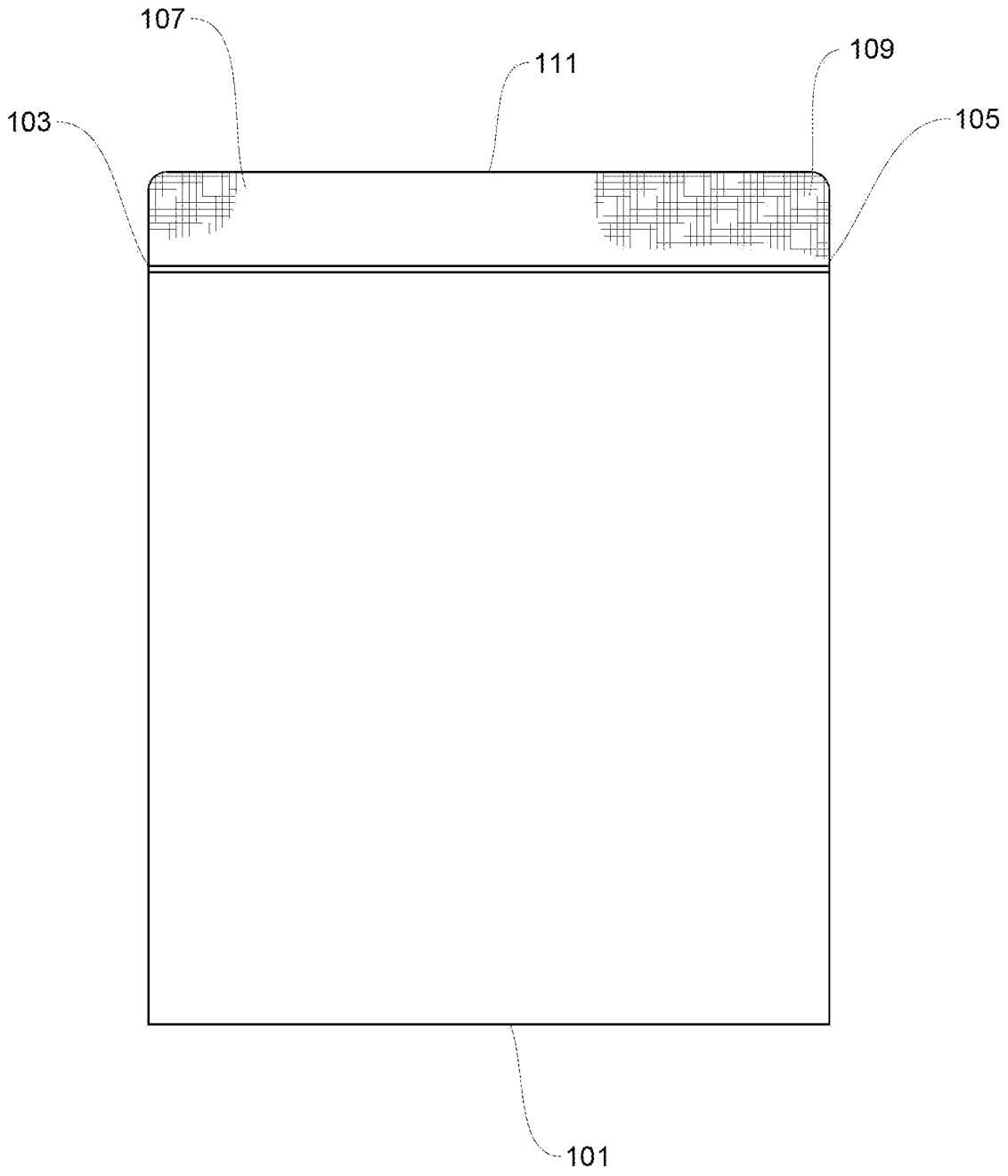
FIG. 1 illustrates a towel according to an embodiment.

FIG. 1 illustrates a towel according to an embodiment.

Towel side 101 is the side of the towel which is used for wiping, cleaning, and the like. Towel side 111 contains the functionality of the present invention for attaching to an object. Seam left side 103 and seam right side 105 connect via the seem joining the end of the towel configured for attaching to an object with a medial portion of the towel, creating a loop in which semirigid member 201 can be enclosed.

Figure 2:
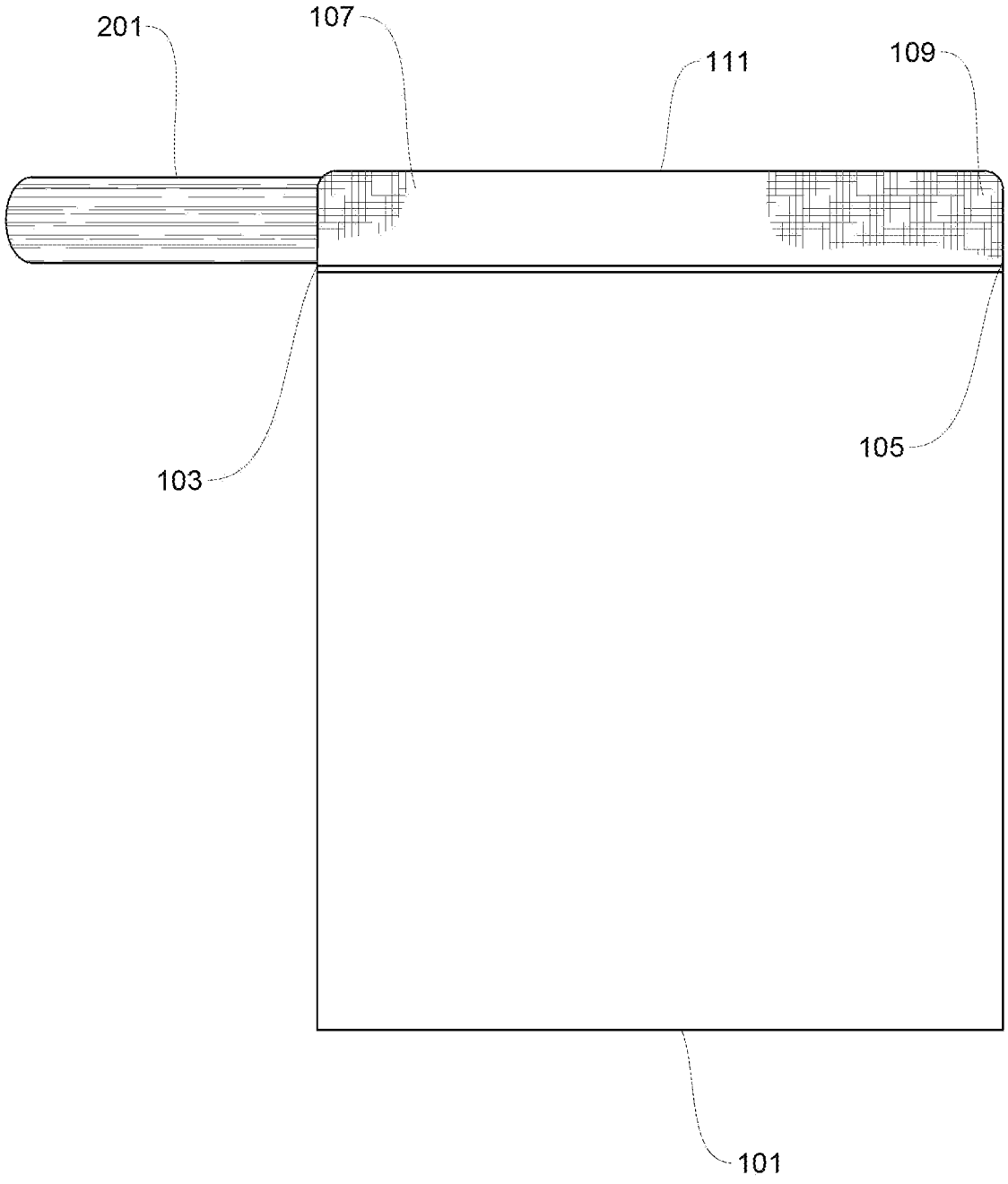
FIG. 2 illustrates a semirigid member enclosed by a towel according to an embodiment.

Not visible in FIG. 1 is semirigid member 201 of FIG. 2, which is arranged to switch between a straight configuration and a curled configuration, wherein the semirigid member is contained within the loop created by the end of the towel configured for attaching to an object being joined at the first seam with the medial portion of the towel.

Left side of the part of the towel configured to curl 107 and right side of the part of the towel configured to curl 109 are arranged to switch between a straight configuration and a curled configuration according to the action of semirigid member 201. In the curled configuration, left side of the part of the towel configured to curl 107 and right side of the part of the towel configured to curl 109 can wrap around an object, with grip maintained by the action of semirigid member 201.

The towel encompassing towel side 101 and towel side 111 can be made of, for example, cotton, polyester, plastic, or any other type of textile material, and can include reflective and/or fluorescent materials for increasing in the visibility of the towel and accordingly increasing the safety of the user, e.g., if the user is riding a bicycle and can more easily been seen by cars.

FIG. 2 illustrates a semirigid member enclosed by a towel according to an embodiment.

Semirigid member 201 is shown halfway inserted into the loop between end of the towel 101 and the seam running from seam left side 103 to seam right side 105. In embodiments, semirigid member 201 can be completely enclosed within 2 seams running perpendicular to the seam running from seam left side 103 to seam right side 105, enclosed on one side by 1 seam perpendicular to the seam running from seam left side 103 to seam right side 105, or not enclosed.

If semirigid member 201 is not completely enclosed, semirigid member 201 can easily be removed from the towel and the towel can be cleaned for example in a washing machine.

Semirigid member 201 can be a curved spring band and can be made of silicone, metal, or other materials. Semirigid member 201 can be, for example, a stainless steel bistable spring band wrapped in a fabric, silicone, or plastic cover. In one state, semirigid member 201 is flat and in the plane of the towel in which it is inserted. In the other state, semirigid member 201 is curved which allows for embodiments of the present invention to wrap around an object.

Semirigid member 201 can be of a variety of lengths and thicknesses depending on the embodiment. In a preferred embodiment, the length of semirigid member 201 might be between 15 and 45 cm, but the length can easily be adapted depending on the application. The towel itself can also be of a variety of different lengths and thicknesses.

Figure 3:
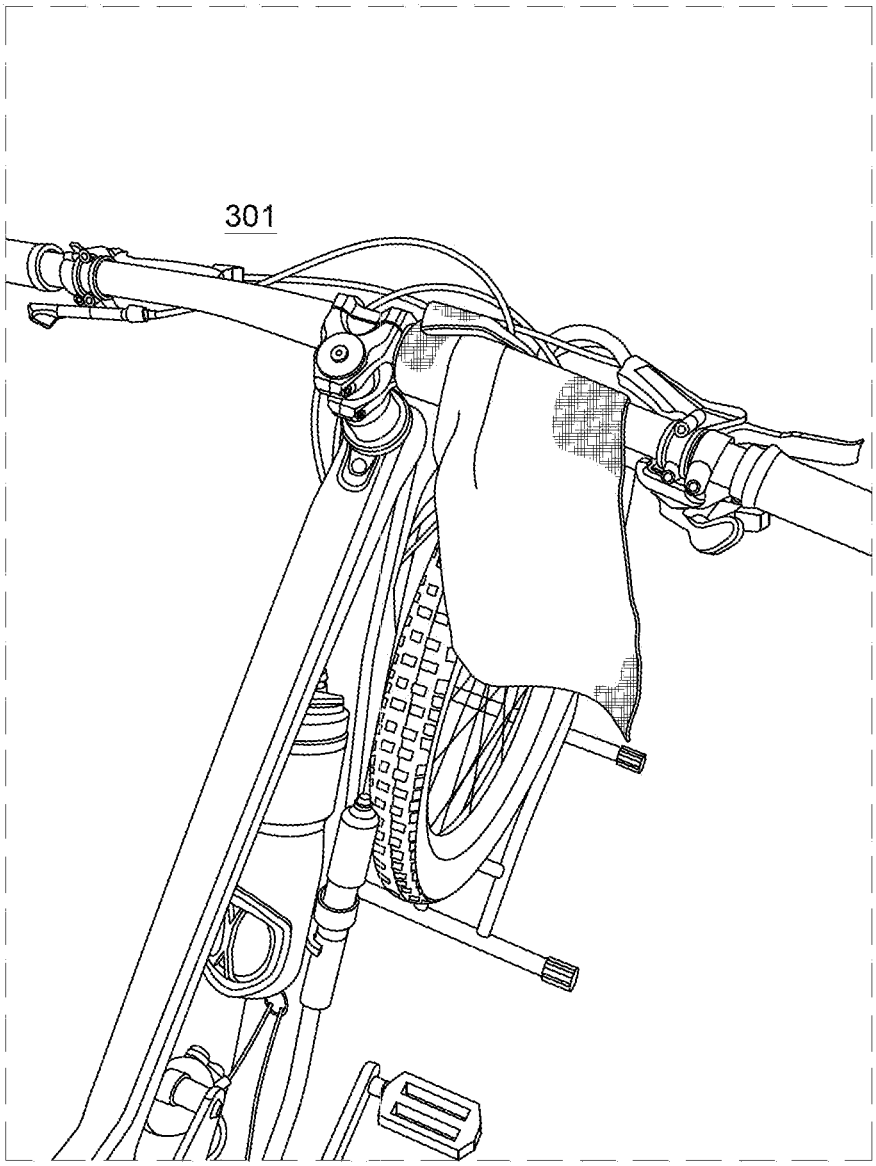
FIG. 3 illustrates a towel attached to an object in an embodiment according to the present invention.

FIG. 3 illustrates a towel attached to an object in an embodiment according to the present invention.

Bicycle handlebars 301 represent an object in a preferred embodiment. Left side of the part of the towel configured to curl 107 and right side of the part of the towel configured to curl 109 can wrap around bicycle handlebars 301 with grip maintained by the action of semirigid member 201.

Towel side 101 is the side of the towel which is used for wiping, cleaning, and the like, and towel side 101 is easily accessible to a rider while towel side 111 is wrapped around bicycle handlebars 301.

The preferred embodiment can be removed from bicycle handlebars 301, e.g., for washing the towel. Left side of the part of the towel configured to curl 107 and right side of the part of the towel configured to curl 109 can switch between the curled configuration wrapped around bicycle handlebars 301 to the straight configuration in which the towel is not attached to bicycle handlebars 301 according to the action of semirigid member 201.

Embodiments of the present invention can be used in any number of contexts including but nearly limited to strollers, golf carts, baby strollers, baby carriers, tool kits, and many other types of objects.

Embodiments may also further comprise one or more pieces of tape. The tape can be silicone anti-slip tape.

Embodiments can also have promotional images adhered to the towel.

What is claimed is:

1. A towel arranged for attaching to an object, comprising:

a first seam joining an end of the towel configured for attaching to an object with a medial portion of the towel; and a semirigid member arranged to switch between two states, wherein the semirigid member is contained within a loop created by the end of the towel configured for attaching to an object being joined at the first seam with the medial portion of the towel;

wherein the semirigid member is a curved spring band; and wherein the two states are a straight configuration and a curled configuration configured to wrap around and grip an object.

2. The towel according to claim 1, wherein the semirigid member is contained on one side by a second seam perpendicular to the first seam.

3. The towel according to claim 1, wherein the semirigid member is contained on two sixes by second and third seems both perpendicular to the first seam.

4. The towel according to claim 1, wherein the semirigid member is made of a material comprising silicone.

5. The towel according to claim 1, wherein the semirigid member is made of a material comprising metal.

6. The towel according to claim 5, wherein a side measures between 25 and 50 cm.

7. The towel according to claim 1, wherein the towel is approximately square in shape.

8. The towel according to claim 7, wherein the longer side measures between 30 and 60 cm.

9. The towel according to claim 1, wherein the towel is rectangular and the side parallel to the semirigid member is shorter than the side perpendicular to the semirigid member.

10. The towel according to claim 1, wherein the towel is made reflective to enhance visibility.

11. The towel according to claim 1, wherein the towel is fluorescent in color.

12. The towel according to claim 1, wherein the towel is made of a material comprising a substantially waterproof material.

13. The towel according to claim 1, wherein the towel is made of a material comprising cotton.

14. The towel according to claim 1, further comprising one or more pieces of tape.

15. The towel according to claim 14, wherein the tape is silicone tape.

16. The towel according to claim 1, further comprising promotional images adhered to the towel.

* * * * *